US008522753B2

(12) United States Patent
Malec et al.

(10) Patent No.: US 8,522,753 B2
(45) Date of Patent: Sep. 3, 2013

(54) HOLDING ELEMENT FOR HOLDING AN ASSEMBLY IN A HOLDER, AND FASTENING ARRANGEMENT

(75) Inventors: Radek Malec, Ceske Budejovice (CZ); Vladimir Ptacek, Praha 4-Modrany (CZ); Martin Ptacek, Ceske Budejovice (CZ); Martin Sykora, Ceske Budejovice (CZ); Josef Jarosik, Ceske Budejovice (CZ); Miloslav Gabris, Ceske Budejovice (CZ)

(73) Assignee: Robert Bosch GmbH, Stuttgart (DE)

( * ) Notice: Subject to any disclaimer, the term of this patent is extended or adjusted under 35 U.S.C. 154(b) by 447 days.

(21) Appl. No.: 12/663,642

(22) PCT Filed: Apr. 11, 2008

(86) PCT No.: PCT/EP2008/054437

§ 371 (c)(1),
(2), (4) Date: Dec. 8, 2009

(87) PCT Pub. No.: WO2008/148602

PCT Pub. Date: Dec. 11, 2008

(65) Prior Publication Data

US 2010/0186194 A1 Jul. 29, 2010

(30) Foreign Application Priority Data

Jun. 8, 2007 (DE) ..... 10 2007 026 670

(51) Int. Cl.
*F02M 61/14* (2006.01)
*F02M 61/16* (2006.01)

(52) U.S. Cl.
USPC ..... 123/470

(58) Field of Classification Search
None
See application file for complete search history.

(56) References Cited

U.S. PATENT DOCUMENTS

| | | | | |
|---|---|---|---|---|
| 5,609,138 | A | 3/1997 | Mutschler | |
| 5,970,953 | A | 10/1999 | Lorraine et al. | |
| 7,360,524 | B2 * | 4/2008 | Zdroik et al. | 123/470 |
| 2002/0139353 | A1 | 10/2002 | Makiyama | |
| 2004/0237939 | A1 * | 12/2004 | Kondo et al. | 123/470 |

FOREIGN PATENT DOCUMENTS

| | | | |
|---|---|---|---|
| DE | 19522042 | A1 | 12/1996 |
| WO | 9904161 | A1 | 1/1999 |
| WO | 0042315 | A1 | 7/2000 |

* cited by examiner

*Primary Examiner* — Jack W. Laviner
(74) *Attorney, Agent, or Firm* — Michael Best & Friedrich LLP

(57) ABSTRACT

Holding elements are known for holding an assembly in a holder, comprising a holding section for engaging behind the assembly and holding members that are provided on the holding section for holding the assembly in the holder. It is disadvantageous that the holding element is comparatively expensive to produce. For example, it is configured very rigidly in the holding direction, which is achieved with a comparatively high amount of material. This results in high production costs. In addition, in the case of very high mechanical loads the detent connection can detach due to torque acting on the detent hooks. The holding element according to the invention is simplified, thereby lowering the production costs. According to the invention, the holding section has a flat configuration viewed in the holding direction, and the holding members are angled in relation to the holding section and configured as elastically resilient holding arms.

6 Claims, 3 Drawing Sheets

HOLDING ELEMENT FOR HOLDING AN ASSEMBLY IN A HOLDER, AND FASTENING ARRANGEMENT

CROSS-REFERENCE TO RELATED APPLICATION

This application is a 35 USC 371 application of PCT/EP2008/054437 filed on Apr. 11, 2008.

BACKGROUND OF THE INVENTION

1. Field of the Invention

The invention is based on a holding element for holding an assembly in a holder and on a fastening arrangement.

2. Description of the Prior Art

A holding element for holding a pressure regulator in a holder is already known from German Patent Disclosure DE 197 24 165 A1 and has a holding portion for engaging the assembly from behind and has holding means, provided on the holding portion, for holding the assembly in the holder. The mounting of the holding element is comparatively complicated, since to secure the detent connection, a securing tab is provided that has to be folded over in an additional work step upon mounting.

ADVANTAGES AND SUMMARY OF THE INVENTION

The holding element of the invention has the advantage over the prior art that the complexity of mounting for the holding element is reduced, since because of the self-locking design, no additional provisions for securing the detent connection are necessary. This is attained by providing that the holding portion is embodied as flat, viewed in the holding direction, and that the holding means are angled relative to the holding portion and embodied as a spring arm. In this way, the holding portion has a large contact area with the assembly, so that the pressure per unit of surface area is reduced, and the durability of the connection is improved.

The holding element can be produced easily, since a single stamping operation and only a few bending operations suffice in the production process.

It is especially advantageous if the detent tongue is positioned obliquely relative to the legs in such a way that in the installed with tension relief acting the legs, it is bent inward relative to the through opening. In this way, a self-locking detent connection is attained, whose detent tongue moves farther toward the detent hook on being mechanically loaded, so that the detent connection remains reliably closed even under very heavy mechanical loads.

It is also advantageous if the detent tongue is embodied as curved or rounded on its free end, since the free end of the dented tongue is more easily movable in this way.

It is very advantageous if contact elements for electrically contacting the assembly are embodied on the annular portion of the holding element, since in this way electrical charges can flow away from the assembly to the holding element, and electrical grounding of the assembly can be attained.

It is also advantageous if the contact means are angled relative to the annular portion and extend in the opposite direction from the holding arms, since in this way the contact elements are embodied as elastically resilient, so that secure electrical contacting is attained.

In an advantageous feature, the contact elements are embodied in tonguelike or striplike form.

It is also advantageous if the holding arms are disposed diametrically opposite on the annular portion, since in this way the detent connection can absorb the maximum holding forces.

It is furthermore advantageous if the holding element is made from flat material, and the holding arms are integrally formed onto the outside, remote from the through opening, and/or the contact elements are integrally formed onto the inside, oriented toward the through opening. The holding element is stamped out from sheet metal in one piece with the holding arms and contact elements.

It is advantageous if an electrical terminal for connecting an electrical conductor is provided, since the electrical discharges can in this way be dissipated from the holding element to an electrical ground.

BRIEF DESCRIPTION OF THE DRAWINGS

The invention will be described in further detail below in conjunction with the drawings, in which.

DESCRIPTION OF THE PREFERRED EMBODIMENT

Figure 1:
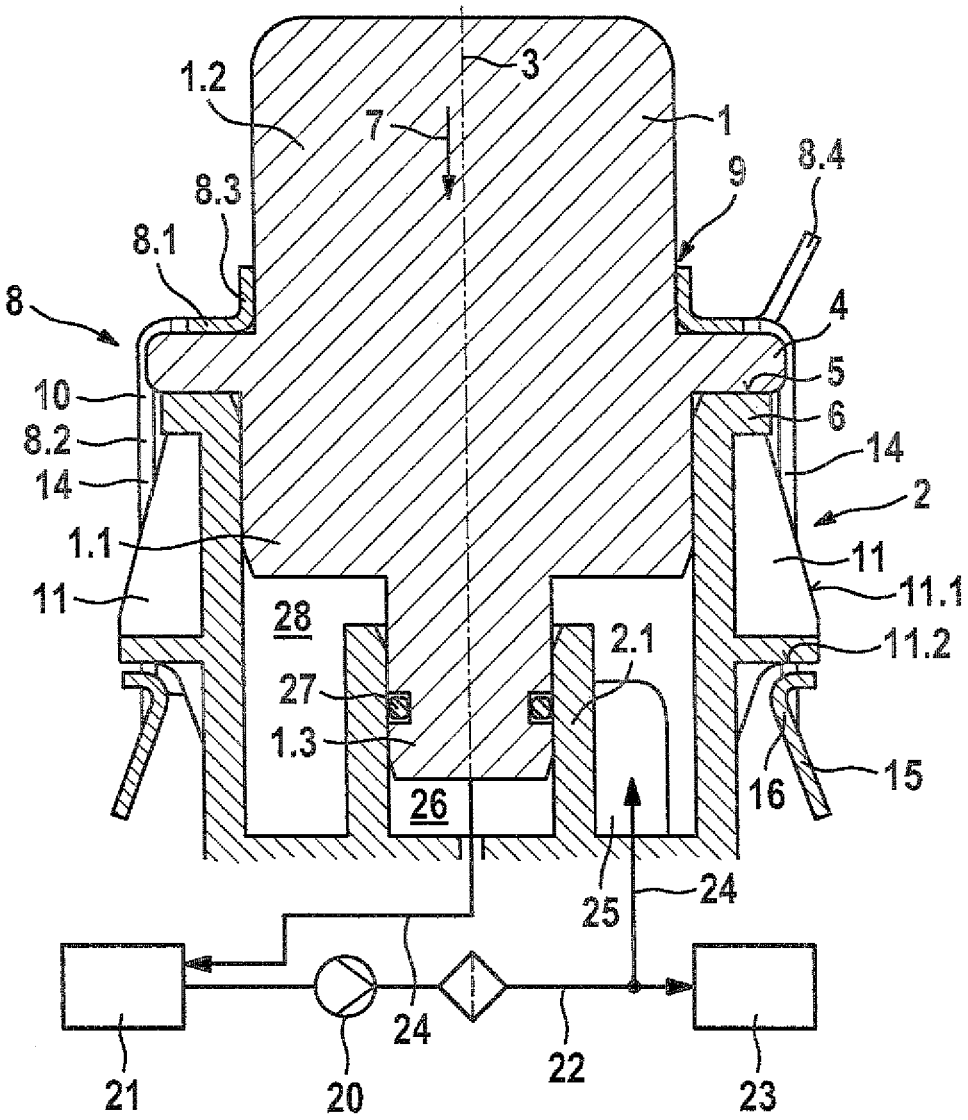
FIG. 1 in section shows an assembly that is held in a holder by means of a holding element according to the invention.

FIG. 1 in section shows an assembly that is held in a holder by means of a holding element according to the invention.

The assembly 1 is inserted with a first housing portion 1.1 into a holder 2 and is held there in the radial direction relative to a longitudinal axis 3 of the assembly 1. The holder 2 is for instance embodied in bushlike form, and the assembly 1 can be inserted with a precise fit into the holder 2. However, the holder 2 could also comprise a plurality of separate holders.

The axial position of the assembly 1 in the holder 2 is determined by a stop 4, which may be provided on either the assembly 1 or the holder 2. The stop 4 determines the depth to which the first housing portion 1.1 plunges into the holder 2. In the exemplary embodiment, the stop 4 is disposed on the assembly 1 and embodied as a shoulder, which for instance extends annularly all the way around the circumference. The assembly 1 is inserted into the holder 2 with the housing portion 1.1 that extends as far as the shoulder 4 and rests with its shoulder 4 on a face end 5 of the holder 2. A shoulderlike flange 6, for instance, is provided on the face end 5 of the holder 2.

The assembly 1 is secured in the holder 2 by means of a holding element 8, so that loosening out of the holder 2 is prevented. The holding element 8 holds the assembly 1 down against the holder 2 in a holding direction 7 in that it engages the assembly 1 from behind with a holding portion 8.1 and is fixed or anchored on the outside of the holder 2 by means of at least two holding means 8.2.

The holding portion 8.1 is embodied annularly or in caplike fashion, for instance, and surrounds a through opening 9, through which the assembly 1 protrudes with a second housing portion 1.2. The shoulder 4 is provided between the first housing portion 1.1 and the second housing portion 1.2. The holding element 8 rests with its holding portion 8.1 on the shoulder 4 of the assembly 1, for example.

According to the invention, viewed in the holding direction 7, the holding portion 8.1 is embodied as flat. This means that the height H of the holding portion 8.1 is substantially less than the width B1 (FIG. 3) of the annular holding portion 8.1. In this way, a large contact area on the assembly 1 is attained, which reduces the pressure per unit of surface area on the assembly 1.

The holding means 8.2 are also angled relative to the holding portion 8.1 and embodied as elastically resilient holding arms. These anus are essentially subjected to tensile stress. The holding arms 8.2 are integrally formed onto the outside, remote from the through opening 9, of the holding portion 8.1 and extend essentially in the axial direction relative to the longitudinal axis 3.

Each of the holding arms 8.2 has a recess 10 that can be locked to a respective detent hook 11 of the holder 2, forming a detent connection. The detent hook 11 is disposed on the outside of the holder 2 and is fowled by a ramp 11.1, which rises in the axial direction remote from the flange 6, and forms a steplike undercut 11.2.

Upon mounting, the holding arm 8.2 snaps elastically with its recess 10 into the detent hook 11, whereupon the crosspiece 15 engages the undercut 11.2 from behind. Because of the recess 10, the holding arms 8.2 have the shape of a "U", each with two legs 14 and one crosspiece or bow 15 (FIG. 2) joining the legs 14.

In the exemplary embodiment, a detent tongue 16 is integrally formed onto the crosspiece 15 and is positioned obliquely at an angle 17 (FIG. 4) relative to the legs 14 in such a way that in the installed state, with tension relief acting on the legs 14, it is bent with its free end elastically inward relative to the longitudinal axis 3. This prevents the holding arm 8.2 from coming unlatched from the detent hook 11 in response to a torque acting outward when a mechanical load is put on the holding arm 8.2. In this way, the detent connection is embodied as self-locking. The detent tongue is positioned obliquely relative to the legs 14 or to the longitudinal axis 3 by approximately 20 to 30° , for instance.

If an axial load is exerted on the assembly 1 in the direction facing away from the holder 2, the crosspiece 15 is braced, for instance by the detent tongue 16, on the undercut 11.2 of the detent hook 11 and because of the oblique disposition is bent elastically radially inward relative to the longitudinal axis 3.

On its free end, the detent tongue 16 is embodied as bent or rounded, so that the free end of the detent tongue 16 is more easily movable in the radial direction.

Besides its holding function, the holding element 8 for instance also has the function of grounding the assembly 1 electrically, or in other words of diverting electrical charges from the assembly 1 to an electrical ground. For that purpose, at least one contact means 8.3 for electrically contacting the assembly 1 is embodied on the holding portion 8.1. The contact means 8.3 are disposed on the inside of the holding portion 8.1, the side oriented toward the through opening 9, and are angled relative to the holding portion 8.1. For instance, they are positioned obliquely to the assembly 1. They extend in the opposite direction from the holding anus 8.2, or in other words in the direction facing away from the holder 2. The contact means 8.3 are embodied in tonguelike, luglike or striplike fashion, for instance. The free ends of the contact means 8.3 are pressed elastically resiliently against the second housing portion 1.2, thus ensuring the electrical contacting of the assembly 1.

The holding element 8 comprises stamped or bent sheet-metal material, such as spring steel, and the holding portion 8.1 of the holding element 8 rests over a large area, that is, with its flat side, on the shoulder 4 of the assembly 1. The holding element 8 is embodied in one piece. The holding arms 8.2 and the contact means 8.3 are accordingly formed integrally in one piece on the holding portion 8.1.

An electrical terminal 8.4 for connecting an electrical conductor is also provided on the holding element 8, in order to dissipate the electrical charges to the electrical ground. The electrical terminal 8.4 is embodied for instance as a connection lug and is integrally formed on the outside of the holding portion 8.1.

The assembly 1 in the exemplary embodiment is a pressure regulator of a fuel delivery device, but it may be any arbitrary other assembly. The fuel delivery device has a delivery unit 20, which delivers fuel, at elevated pressure, from a fuel tank 21 to an internal combustion engine 23 via a pressure line 22. From the pressure line 22, a return line 24 branches off that discharges into an inlet 25 to the holder 2. The pressure regulator opens beyond a predetermined pressure in the inlet 25 and allows fuel to flow back into the fuel tank 21 via an outlet 26 of the holder 2. The pressure regulator is for instance a known diaphragm pressure regulator, which has a diaphragm body that cooperates with a valve seat.

Together with the pressure regulator inserted into the holder 2, the holder encloses an inner chamber 28, into which the inlet 25 discharges. The outlet 26 is embodied in stublike fashion, for instance, and protrudes into the inner chamber 28. The fluidic communication from the inlet 25 to the outlet 26 of the holder 2 is controlled by the pressure regulator.

With an outlet stub 1.3, the pressure regulator protrudes with a precise fit into the outlet 26 of the holder 2. A sealing means 27, which seals off the connection, is provided on the outlet stub 1.3.

As a result of the hydraulic pressure of the pressure line 22, a force acts on the pressure regulator in an axial direction facing away from the holder 2, and this force seeks to force the pressure regulator out of the holder 2. The holding element 8 acts counter to this force and securely holds the pressure regulator in the holder 2.

Upon mounting, the assembly 1 is inserted into the holder 2. Next, the holding element 8 is slipped onto the assembly 1, and the holding arms 8.2 are locked resiliently to the detent hooks 11.

Figure 2:
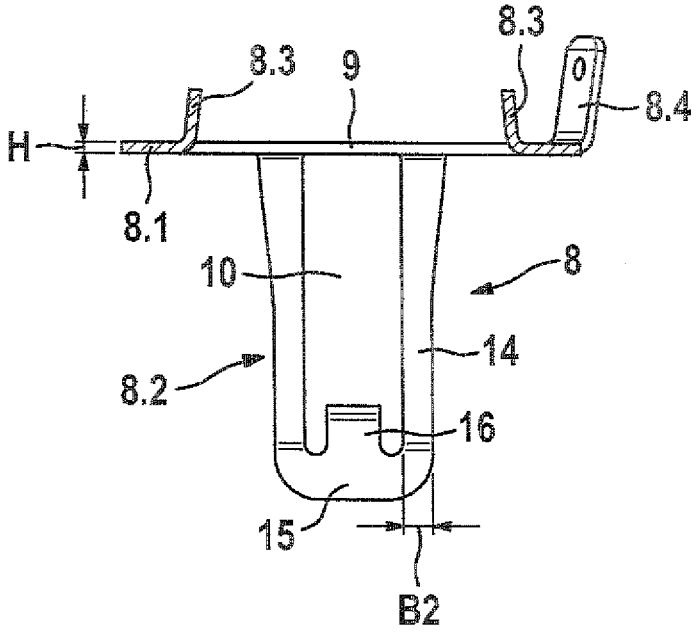
FIG. 2 is a side view of the holding element of the invention.

FIG. 2 in section is a side view of the holding element of the invention.

In the holding element of FIG. 2, the parts that remain the same or function the same as in the view in FIG. 1 are identified by the same reference numerals.

The width B2 of the legs 14 for instance increases toward the holding portion 8.1.

Figure 3:
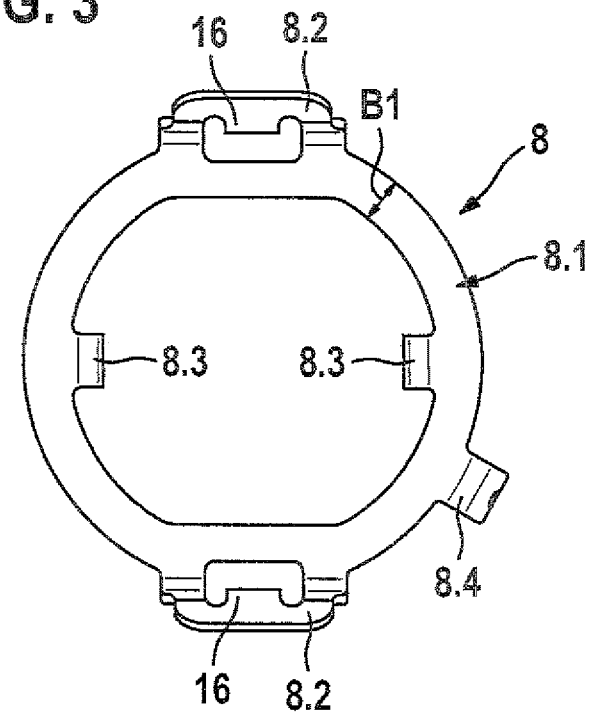
FIG. 3 is a top view on the holding element of the invention.

FIG. 3 is a top view on the holding element of the invention.

In the holding element of FIG. 3, the parts that remain the same or function the same as in the view in FIGS. 1 and 2 are identified by the same reference numerals.

The holding arms 8.2 are disposed diametrically opposite on the holding portion 8.1. Two contact means 8.3 are for instance provided for electrically contacting the assembly 1, but more or fewer than two contact means 8.3 may also be provided.

Figure 4:
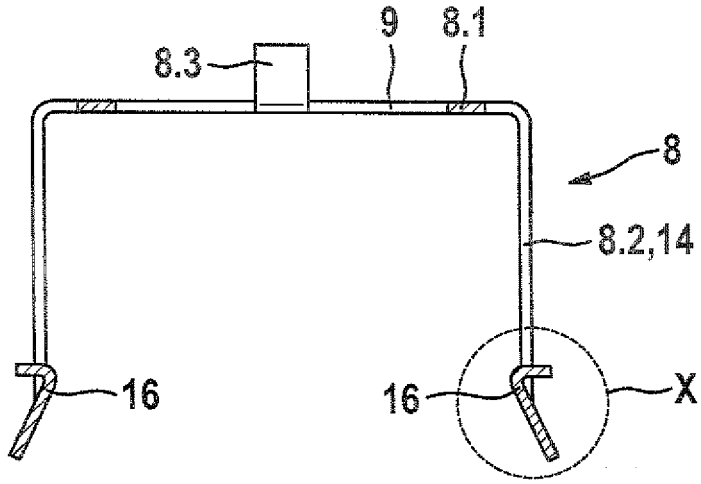
FIG. 4 is a further side view of the holding element of the invention.

FIG. 4 is a further side view of the holding element of the invention.

In the holding element of FIG. 4, the parts that remain the same or function the same as in the view in FIGS. 1 through 3 are identified by the same reference numerals.

Figure 5:
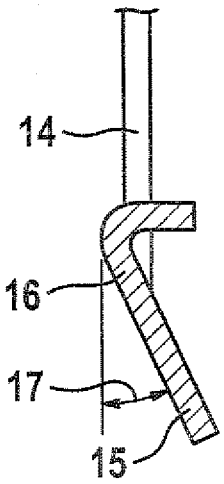
FIG. 5 shows a detail of the holding element of the invention in FIG. 4.

FIG. 5 shows a detail X of the holding element of the invention in FIG. 4.

In the holding element of FIG. 5, the parts that remain the same or function the same as in the view in FIGS. 1 through 4 are identified by the same reference numerals.

The foregoing relates to the preferred exemplary embodiment of the invention, it being understood that other variants and embodiments thereof are possible within the spirit and scope of the invention, the latter being defined by the appended claims.

The invention claimed is:

1. A fastening arrangement, comprising:

a holder;

an assembly that is disposed in the holder which has detent hooks with undercuts; and a holding element holding the assembly in the holder, the holding element including:

a holding portion comprising a flat annular planar member with a through opening for engaging the assembly from said rear side of the assembly;

holding means provided on the holding portion for holding the assembly in the holder, the holding means being angled relative to the holding portion and being embodied as elastically resilient holding arms; and said holding arms each have at least two legs extending normally from said holding portion with first ends connected to said holding portion and opposite second ends connected to a crosspiece joining the legs, and a detent tongue extending from the crosspiece, which tongue is positioned obliquely relative to the legs such that in an installed state, with tension relief acting on the legs, the tongue is bent toward the holder, wherein at least one electrical terminal is provided on said holding portion for connecting an electrical conductor, and wherein the holding element is fastened with its holding arms on the detent hooks of the holder.

2. The fastening arrangement as defined by claim 1, wherein the detent tongue is bent or rounded on its free end.

3. The fastening arrangement as defined by claim 1, wherein the holding means are disposed on an outside of the holding portion.

4. The fastening arrangement as defined by claim 1, wherein said at least one electrical terminal is disposed on an inside of the holding portion for electrically contacting the assembly, and wherein said at least one terminal is angled relative to the holding portion.

5. The fastening arrangement as defined by claim 1, wherein the holding means in the form of two holding arms are disposed diametrically opposite from one another on the holding portion.

6. The fastening arrangement as defined by claim 1, wherein the holding element is made from flat material.

* * * * *

UNITED STATES PATENT AND TRADEMARK OFFICE

CERTIFICATE OF CORRECTION

PATENT NO. : 8,522,753 B2
APPLICATION NO. : 12/663642
DATED : September 3, 2013
INVENTOR(S) : Malec et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 566 days.

Signed and Sealed this
Fifteenth Day of September, 2015

Michelle K. Lee

Michelle K. Lee
*Director of the United States Patent and Trademark Office*